United States Patent [19]

Mizelle

[11] Patent Number: 4,690,454

[45] Date of Patent: Sep. 1, 1987

[54] RECLINER UNIT WITH NOVEL LOCKING AND ACTUATING MECHANISM

[76] Inventor: Ned W. Mizelle, P.O. Box 5985, High Point, N.C. 27262

[21] Appl. No.: 749,409

[22] Filed: Jun. 27, 1985

[51] Int. Cl.[4] ..... A47C 1/02

[52] U.S. Cl. ..... 297/89; 297/85; 297/322; 297/329

[58] Field of Search ..... 297/83–86, 297/88, 89, DIG. 7, 311, 321, 322, 329, 342

[56] References Cited

U.S. PATENT DOCUMENTS

| | | | |
|---|---|---|---|
| 4,071,275 | 9/1978 | Rogers, Jr. | 297/86 X |
| 4,113,305 | 9/1978 | Hampton | 297/85 X |
| 4,179,157 | 12/1979 | Shoemaker et al. | 297/83 |
| 4,226,469 | 10/1980 | Rogers, Jr. et al. | 297/322 X |
| 4,346,933 | 8/1982 | Jacobs | 297/329 X |
| 4,494,793 | 1/1985 | Rogers, Jr. | 297/85 |

*Primary Examiner*—Kenneth J. Dorner

*Assistant Examiner*—Peter R. Brown

*Attorney, Agent, or Firm*—Beveridge, DeGrandi and Weilacer

[57] ABSTRACT

A novel unlocking mechanism is provided in a recliner which has a stationary frame, left and right mechanisms for supporting a seat frame for movement on the stationary frame and for supporting and operating a legrest for movement between retracted and extended positions. The locking mechanism is spaced from and located between the recliner mechanisms, and it is formed of pivoted links, one of which is a toggle link which occupies an immovable over center position when the seatframe is in its rear position. A release wire operating the unlocking lever is used to move the toggle member from its own center position so that the locking mechanism can collapse and the seat frame may move to its forward position. The release wire has an exposed unlevered pull handle which is readily accessable to a user of the recliner.

18 Claims, 5 Drawing Figures

RECLINER UNIT WITH NOVEL LOCKING AND ACTUATING MECHANISM

BACKGROUND OF THE INVENTION

This invention relates to recliner chairs and other articles of furniture such as loveseats which use the recliner chair mechanisms. Typical recliners are classified in the U.S. patent classification system in Class 297, subclasses 85 and 89. In these units, a seat frame is supported on a stationary frame by means of a mechanism which has both seat support linkages and leg rest support linkages.

Many recliner mechanisms are designed so that the seat frame is easily moved from its rear normally-pitched position to its forward position where it assumes a greater pitch. To prevent inadvertent movement of the seat frame to the forward position, it is customary to provide some type of locking mechanism. These locking mechanisms are usually built into the left and/or right mechanisms which support the seat frame on the stationary frame. If such a locking mechanism is provided only on one side, undesired movement may occur on the opposite side. If locking mechanisms are provided on both sides of the unit, difficulties are sometimes encountered in achieving the desired situation of having both mechanisms lock simultaneously and unlock simultaneously.

Another problem which has existed in certain types of recliners is that they require a lever mechanism for actuating the locking means. Such levers detract from the aesthetics of the furniture pieces and they reduce the flexibility the furniture designer has as to the optimum design. For example, a relatively high arm frame is usually required for a lever, and the lever is usually exposed on the outboard side of this frame.

Due to the characteristics of the present invention, the locking mechanism is simple, reliable, and it does not require the presence of an exposed actuation lever.

SUMMARY OF THE INVENTION

This invention is applicable to recliner mechanisms of a known type wherein there is a stationary frame with a back frame portion, a left side frame portion and a right side frame portion. A seat frame is located between the side frame portions, and a leg rest is located at a forward portion of the recliner. Left and right recliner mechanisms connect the left and right sides of the seat frame to the corresponding left and right side portions of the stationary frame. Each recliner mechanism has a seat linkage means for supporting the seat frame for movement relative to the stationary frame between a rear position and a forward position which has a greater pitch from the horizontal and the rear position. Each recliner mechanism also has a leg rest linkage which supports the leg rest for movement between a retracted position where it is generally vertical and an extended position where it is generally horizontal and extends in a forward direction. The recliner is also conventional in the respect that it has a locking mechanism for holding the seat frame in its rear position.

According to the present invention, the locking mechanism is spaced from and located between the recliner mechanisms, and it has its opposite ends connected to the seat frame and to the stationary frame. More significantly, the locking mechanism includes pivotally interconnected links, one of which is a toggle member which is movable to an over center position where it prevents the locking mechanism links from pivoting relative to each other when the locking mechanism is subjected to longitudinal compressive forces. Unlocking means are provided for moving the toggle member from its over center position so that the links of the locking mechanism are able to pivot relative to each other to enable the seat frame to move to its forward position. The unlocking means includes a flexible tension member which, when pulled by a user of the recliner, moves the toggle member out of its over center position.

Preferably, the flexible tension member runs through a guide conduit which has one end movably attached to one of the frames and another end which is immovably attached to one of the frames. The unlocking means preferably includes a pivoted unlocking lever to which the flexible tension member is connected. The components are located where a pulling action on the flexible tension member moves the unlocking lever against the toggle member to move that toggle member from its over center position to unlock the seat frame. The unlocking lever and the toggle member are arranged with a lost motion between them so that, after the toggle member moves over center, it then moves a greater distance than the unlocking lever. The flexible tension member preferably has an exposed unlevered manually engagable pull handle at one end, and this pull handle may be mounted either on the movable seat frame or on a stationary frame member.

Further important aspects of the invention will be appreciated from an inspection of the drawings and a study of the following detailed description.

DETAILED DESCRIPTION

Figure 1:
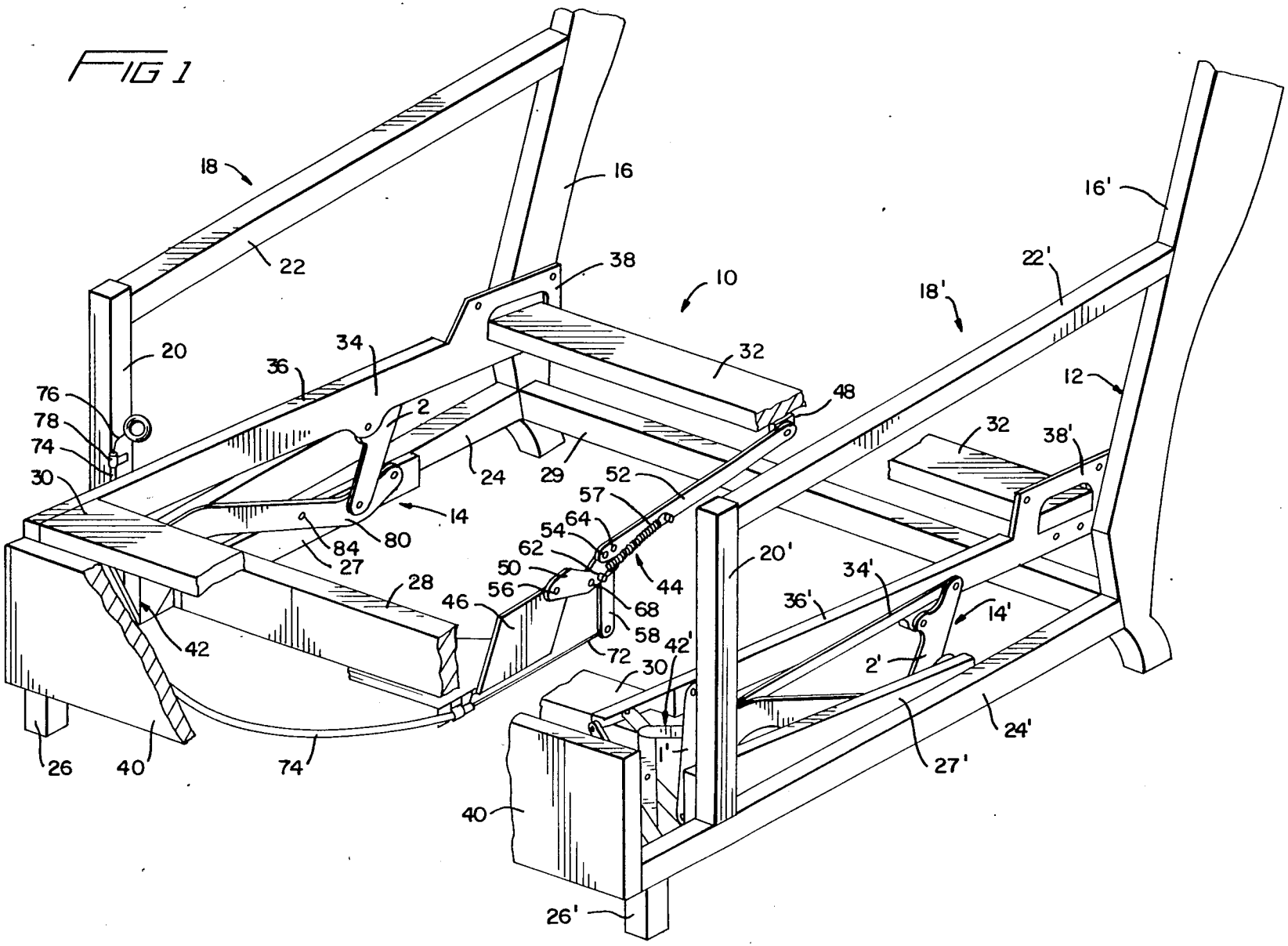
FIG. 1 is a somewhat diagramatic perspective view, partially broken, showing the internal workings of a recliner chair constructed according to the invention.

FIG. 1 shows a chair constructed according to the invention wherein a seat frame 10 is movably mounted on a stationary frame 12 by a pair of mechanisms 14 and 14'. These components are well known and are readily recognizable by persons of ordinary skill in the furniture industry. In the industry, the terms "left" and "right" are used to indicate directions which are left and right to a person facing the article of furniture rather than one seated therein, so the normal industry terminology will be used in this specification.

The stationary frame 12 has an outer back frame with upright back posts 16 and 16', and one or more transverse cross rails which are not shown in the drawings. The stationary frame 12 has a left arm or side portion 18 formed of a front rail 20, an upper rail 22, and a lower rail 24, the latter two rails being connected to the left back post 16. The right side of the stationary frame includes an upper rail 22', a lower rail 24', and an upright rail 20' which are connected together as shown.

The stationary frame also has forward foot portions 26 and 26', linkage mounting blocks 27 and 27' affixed on the interior surfaces of the rails 24 and 24', and front and rear cross rails 28 and 29.

The movable seat frame 10 is located between the left and right side frames and it is formed of cross rails 30 and 32 and side rails 34 and 34' the latter of which are manufactured as components of the linkage mechanisms 14 and 14'. These side rails have horizontal flanges which underlie the opposite ends of the cross rails 30 and 32 and are screwed or bolted thereto to provide a secure assembly. The side rails 34 and 34' have horizontal stiffening flanges 36 and 36' located at their upper edges, and vertical attachment flanges 38 and 38' located at their rear ends. The flanges 38 and 38' are securely bolted to an inner back frame, not shown, which lies between and projects somewhat forwardly of the outside back posts 16 and 16' and is rigidly affixed to the seat frame so that the inclining action of the unit simultaneously affects both the inside back frame and the seat frame.

At a forward portion of the recliner, there is a leg rest 40 which is supported and controlled by leg rest linkages 42 and 42' which are described in greater detail in a subsequent portion of this specification. Each of these linkages 42 and 42' supports the leg rest for movement between the generally vertical retracted position shown in FIG. 1 and a forwardly disposed generally horizontal extended position which can be seen in FIG. 5.

The support and movement of the seat frame 10 is provided by the seat linkages which are four bar linkages including a pair of support links 1 and 2 or 1' and 2'. The seat linkages are operable to support the seat frame 10 for movement relative to the stationary frame 12 between a rear position and a forward portion where it has a greater pitch from the horizontal than when in its rear position.

As described thus far in this specification, the recliner frame components and mechanisms are of conventional construction. A similar arrangement is described in somewhat greater detail in U.S. Pat. No. 4,291,913 which is incorporated herein by reference.

Recliners of this general type require some type of locking mechanism for maintaining the seat frame 10 in its rearward position under conditions of normal use. Such locking mechanisms are often incorporated directly in the left or right mechanism assemblies. Experience has shown that when the left mechanism is locked, there is some undesired movement in the right side of the unit, and vice versa. In instances where locking mechanisms have been mounted on both the left and right sides of a unit, problems have been experienced in getting both mechanisms to lock and unlock simultaneously. Common actuators have been used, but they complicate the mechanisms and require the use of shafts, levers and additional components.

The present invention involves a recliner chair which has an improved locking mechanism associated with the recliner components. This mechanism, designated generally 44, is spaced from and located between the left and right mechanisms 14 and 14'. The forward end of the locking mechanism 44 is connected by a mounting bracket 46 to the cross rail 28 of the stationary frame 12, and the rear end of the locking mechanism is pivotally connected by bracket 48 to the rear cross rail 32 of the seat frame.

The locking mechanism includes a pair of links 50 and 52 which are pivotally interconnected at 54. The link 50, denoted a toggle member for reasons which will be understood, has its forward end pivotally connected at 56 to the bracket 46. A tension toggle spring 57 extends between protruding rivets 60 and 62 on the toggle link 50 and the rear link 52.

The mechanism 44 also has a bellcrank unlocking lever 58 which is pivotally supported on the pivot 56.

Figure 2:
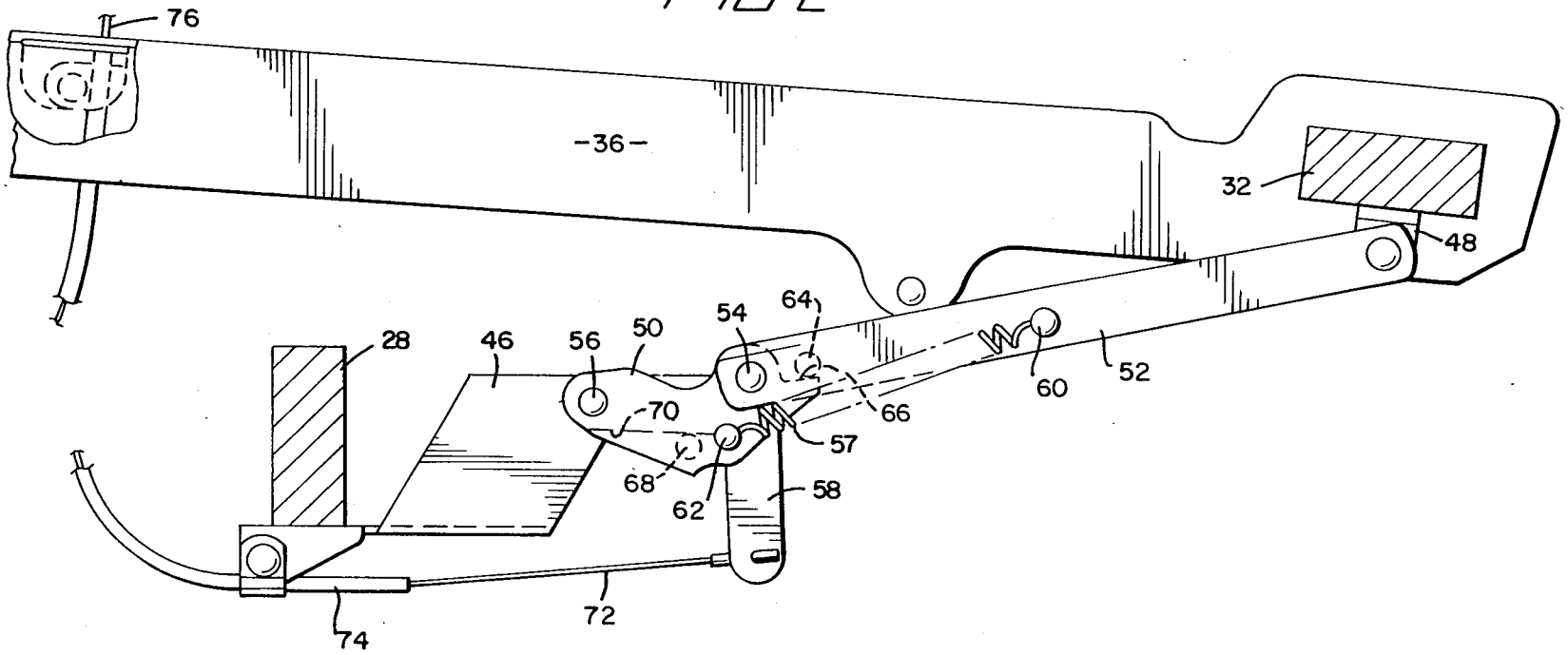
FIG. 2 is a side view of the recliner locking mechanism when in its locked position.
Figure 3:
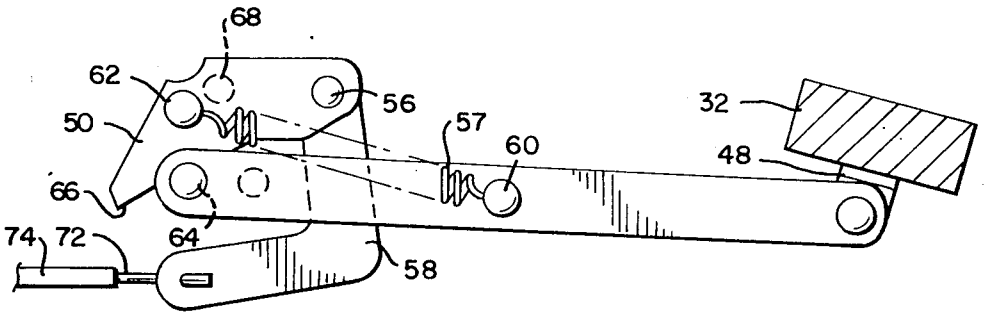
FIG. 3 is a view similar to FIG. 2, but showing the recliner locking mechanism in its unlocked condition.
Figure 4:
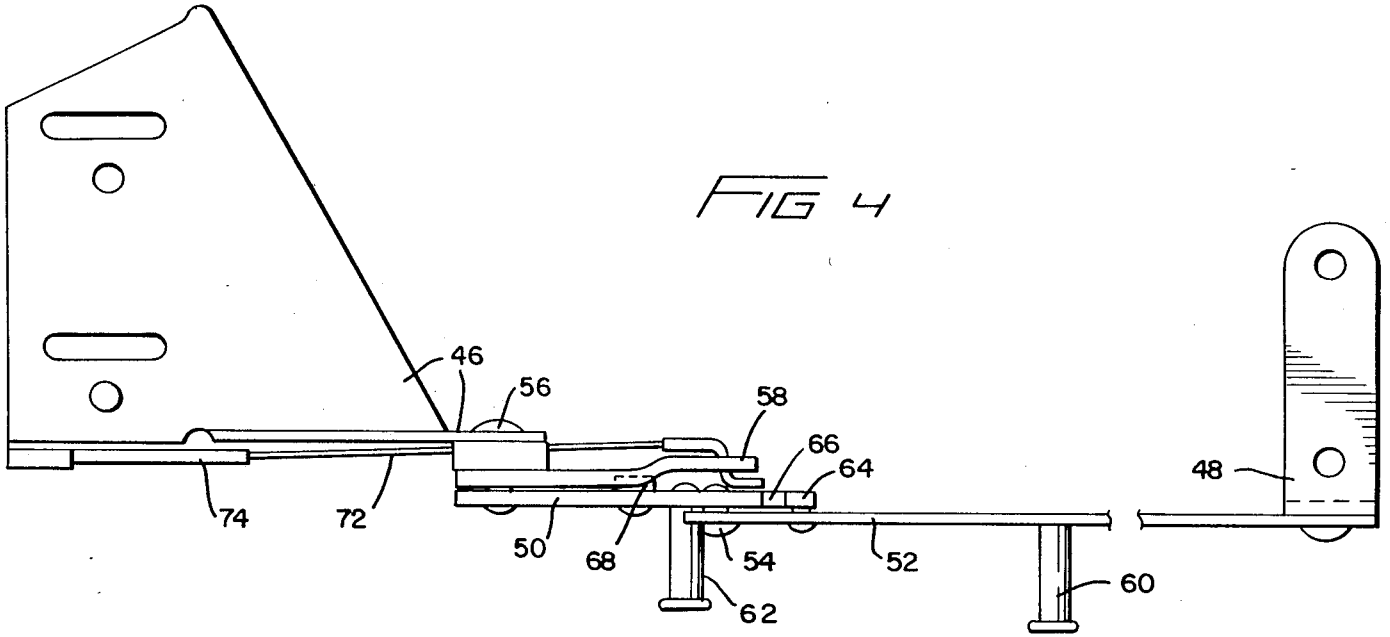
FIG. 4 is a plan view of the locking mechanism in its locked position.

Referring to FIGS. 2 and 3, it will be seen that the rear link 52 has a shoulder stud 64 which protrudes from its left side to engage an edge 66 of the toggle member 50 in order to limit the pivoting action between the links 50 and 52. The toggle member 50 has a shoulder stud 68 protruding from its left side in the path of the lower edge 70 of the bellcrank lever 58. It will be appreciated that, due to the presence of the toggle spring 58, the locking mechanism is quite stable when in the position illustrated in FIG. 2, as the tension exerted by the spring 57 between the links 50 and 52 holds the edge 66 firmly against the shoulder stud 64.

The lower end of the bellcrank lever 58 has an aperture which receives one end of an actuator wire 72 or other flexible tension member. This wire 72 leads through a conduit 74 to a position where its upper end 76 is exposed and capable of being pulled to unlock the locking mechanism. The lower end of the conduit 74 is attached to bracket 46 by a conventional clamping device, and the upper end of the conduit is attached either to the stationary left side frame or to the seat frame 10 by a bracket 78 which has a conventional conduit-engaging clamp. Mechanisms of this nature are well known and are often referred to as Boden wire units. The upper end of the wire 72 is provided with a manually engageable ring or other pull handle which is exposed so that a user may pull the wire to actuate the unlocking mechanism. Tension moves the wire and forces the edge 70 of bellcrank 58 to bear downwardly on the shoulder stud 68 until the axis of pivot 54 passes beyond the axis of the toggle spring 57, at which time the mechanism will continue movement to its final position. This movement drives the rear seat rail 32 in a forward direction until the seat support links 1 and 2 move beyond the vertical, at which point the weight of the seat and inside back sustain this movement until the seat frame arrives at its forward inclined position.

It will also be observed that the bellcrank 58 is arranged so that it provides a lost motion between the actuator wire 72 and the toggle link 50. After the toggle link 50 moves over center, it continues its movement through a greater distance than the wire 72 and bellcrank lever 58. This will be evident from FIG. 3 which shows the unit when in its reclined and unlocked condition.

Figure 5:
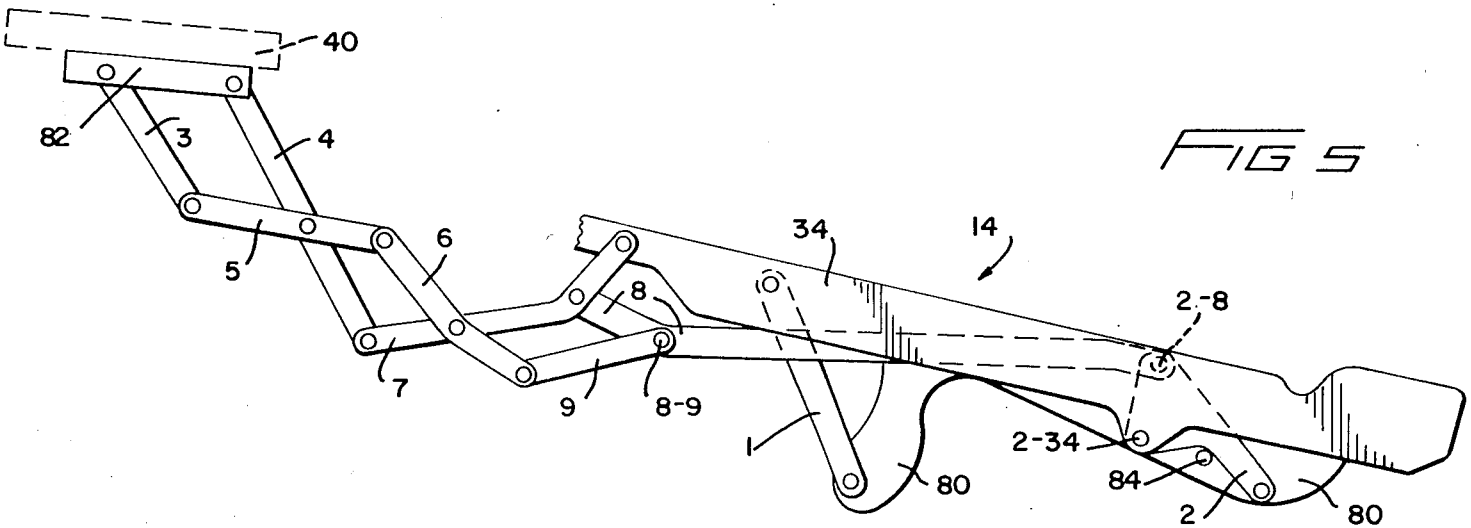
FIG. 5 is a diagramatic side view showing the recliner mechanism including the linkages for supporting the seat and leg rest.

The left side rail mechanism is shown in greater detail in FIG. 5 wherein, for ease of understanding, the links have been identified by the numerals 1 through 9, and their points of interconnection are identified by hyphenated numbers, the components of which identify the links which are interconnected. For example, the reference numeral 8-9 identifies a pivotal connection between the link 8 and the link 9.

The mechanism 14 has a mounting plate 80 which, as previously seen in FIG. 1, is affixed to the mounting block 27 on the stationary frame. The seat rail is supported by a pair of support links 1 and 2 which are components of a four bar linkage. A leg rest bracket 82 is attached to the rear surface of the leg rest 40, and it is supported and moved by a set of scissors links 3-9. In a manner well known in the art, the mechanism moves the leg rest from the relatively upright rear position shown in solid lines to the forward inclined position due to the forward swinging movement of the support links 1 and 2. This movement is terminated, in part, by a stop member 84 located on the mounting plate 80 at a position located in the path of the rear support link 2. During this forward swinging movement of the links 1 and 2, the leg rest control link 8 exerts a forwardly directed force on the link 6 and the other links of the leg rest actuating linkage 42, thereby driving the leg rest 40 to its extended position.

Persons familiar with the art will realize that the recliner may take various forms other than the two way recliner shown in this specification. The units may be conventional chairs as illustrated, or they may be loveseats, pit group units or other pieces. The side rails may simply be single rails which support the mechanism on the floor. As the invention does not require a sidewardly accessable actuating lever, it is particularly useful in connection with pit group types in which the upper end of the conduit may be simply affixed to the side rail of the seat frame. The actuator in fact can be concealed between the side frame and a cushion, or it may be exposed to provide a decorative effect, possibly as a metallic ring or ornamented with a fabric which corresponds to or contrasts with the upholstery fabric of the furniture piece.

Because the invention may take many different forms other than those described in this specification, it is emphasized that the invention is not limited solely to the disclosed embodiments but is embracing of other structures which fall within the spirit of the following claims.

I claim:

1. A recliner, comprising, a stationary frame having a back frame portion, a left side frame portion, and a right side frame portion, a seat frame which is located between said side frame portions, a leg rest which is located at a forward portion of the recliner, a left recliner mechanism connecting the left side of said seat frame to the left side frame portion, a right recliner mechanism connecting the right side of said frame to the right side frame portion, each of said recliner mechanisms including a seat linkage means and a leg rest linkage means, said seat linkage means being operable to support said seat frame for movement relative to said stationary frame between a rear position and a forward position which has a greater pitch from the horizontal than said rear position, said seat linkage means including seat support links which are inclined rearwardly when the seat frame is in its rear position, said seat support links being inclined forwardly when the seat frame is in its forward position, said leg rest linkage means being operable to support the leg rest for movement between a retracted position where it is generally vertical and an extended position where it is generally horizontal and extends in a forward direction, a locking mechanism for holding the seat frame in its rear position at which said seat support links are inclined rearwardly, said locking mechanism being spaced from and located between the recliner mechanisms and having its opposite ends connected to the seat frame and to the stationary frame, said locking mechanism including pivotally interconnected links, one of which is a toggle member movable to an over center position where it prevents the links of the locking mechanism from pivoting relative to each other when the locking mechanism is subjected to longitudinal compressive forces, and unlocking means for moving the toggle member from its over center position so that the links of the locking mechanism are able to pivot relative to each other to enable the seat support links to move to positions where they are inclined forwardly and to enable the seat frame to move to its forward position, said unlocking means including a flexible tension member which, when pulled by a user of the recliner, causes the toggle member to move from its over center position.

2. A recliner according to claim 1 wherein the flexible tension member has an exposed unlevered manually engageable pull handle at one end thereof.

3. A recliner according to claim 2 wherein the pull handle is mounted on the seat frame.

4. A recliner according to claim 2 wherein the pull handle is mounted on the stationary frame.

5. A recliner according to claim 1 having a guide conduit which receives the flexible tension member, said guide conduit having one end which is immovably attached to one of said frames and another end which is immovably attached to one of said frames.

6. A recliner according to claim 5 wherein the flexible tension member has an exposed unlevered manually engageable pull handle at one end thereof.

7. A recliner according to claim 6 wherein the pull handle is mounted on the seat frame.

8. A recliner according to claim 6 wherein the pull handle is mounted on the stationary frame.

9. A recliner according to claim 5 wherein the unlocking means includes a pivoted unlocking lever, said flexible tension member being connected to the unlocking lever and being located where a pulling action on the flexible tension member moves the unlocking lever against the toggle member to move the toggle member from its over center position to unlock the seat frame, said unlocking lever and said toggle member being arranged with a lost motion therebetween so that, after the toggle member moves over center, it then moves a greater distance than the unlocking lever.

10. A recliner according to claim 9 wherein the flexible tension member has an exposed unlevered manually engageable pull handle at one end thereof.

11. A recliner according to claim 10 wherein the pull handle is mounted on the seat frame.

12. A recliner according to claim 10 wherein the pull handle is mounted on the stationary frame.

13. A recliner, comprising:

a stationary frame having a back frame portion, a left side frame portion, and a right side frame portion, a seat frame which is located between said side frame portions, a leg rest which is located at a forward portion of the recliner, a left recliner mechanism connecting the left side of said seat frame to the left side frame portion, a right recliner mechanism connecting the right side of said seat frame to the right side frame portion, each of said recliner mechanisms including a seat linkage means and a leg rest linkage means, said seat linkage means being operable to support said seat frame for movement relative to said stationary frame between a rear position and a forward position which has a greater pitch from the horizontal than said rear position, said leg rest linkage means being operable to support the leg rest for movement between a retracted position where it is generally vertical and an extended position where it is generally horizontal and extends in a forward direction, a locking mechanism for holding the seat frame in it rear position, said locking mechanism being spaced from and located between the recliner mechanisms and having its opposite ends connected to the seat frame and to the stationary frame, said locking mechanism including pivotally interconnected links, one of which is a toggle member movable to an over center position where it prevents the links of the locking mechanism from pivoting relative to each other when the locking mechanism is subjected to longitudinal compressive forces, and unlocking means for moving the toggle member from its over center position so that the links of the locking mechanism are able to pivot relative to each other to enable the seat frame to move to its forward position, said unlocking means including a flexible tension member which, when pulled by a user of the recliner, causes the toggle member to move from its over center position, said unlocking means including a pivoted unlocking lever, said flexible tension member being connected to the unlocking lever and being located where a pulling action on the flexible tension member moves the unlocking lever against the toggle member to move the toggle member from its over center position to unlock the seat frame, said unlocking lever and said toggle member being arranged with a lost motion therebetween so that, after the toggle member moves over center, it then moves a greater distance than the unlocking lever.

14. A recliner according to claim 13 wherein the flexible tension member has an exposed unlevered manually engageable pull handle at one end thereof.

15. A recliner according to claim 14 wherein the pull handle is mounted on the seat frame.

16. A recliner according to claim 14 wherein the pull handle is mounted on the stationary frame.

17. A recliner, comprising, a stationary frame, a seat frame mounted on the stationary frame, a pair of recliner mechanisms mounting the seat frame on the stationary frame, each of said recliner mechanisms including a seat linkage means which is operable to support said seat frame for movement relative to the stationary frame between a rear position and a forward position which has a greater pitch from the horizontal than said rear position, said seat linkage means including seat support links which are inclined rearwardly when the seat frame is at said rear position, a lever means for moving the seat frame in a forward direction until the seat support links move beyond the vertical, at which point the weight of the seat causes the seat frame to move on said seat support links to said forward position, and a lost motion connection means associated with said lever to permit the seat frame to move independently of the movement of the lever.

18. A recliner according to claim 17 having a locking mechanism for holding the seat frame in its rear position, said locking mechanism including two pivotally interconnected links, one said link being connected to the seat frame and the other said link being connected to the stationary frame, said lever being engaged with one of said links to produce relative movement between said links to unlock said locking mechanism.

* * * * *